US005941575A

United States Patent [19]

Herbst

[11] Patent Number: 5,941,575

[45] Date of Patent: Aug. 24, 1999

[54] TELESCOPING VACUUM-CLEANER SUCTION PIPE ASSEMBLY

[75] Inventor: Thomas Herbst, Arnsberg, Germany

[73] Assignee: Carl Froh GmbH, Sundern, Germany

[21] Appl. No.: 09/012,945

[22] Filed: Jan. 23, 1998

[30] Foreign Application Priority Data

Feb. 14, 1997 [DE] Germany ..... 197 05 545
May 27, 1997 [DE] Germany ..... 197 22 195

[51] Int. Cl.[6] ..... F16L 35/00

[52] U.S. Cl. ..... 285/7; 285/303; 285/316

[58] Field of Search ..... 285/7, 315, 316, 285/317, 318, 303

[56] References Cited

U.S. PATENT DOCUMENTS

| | | | |
|---|---|---|---|
| 3,244,437 | 4/1966 | Belicka | 285/7 |
| 3,351,363 | 11/1967 | Downey . | |
| 4,641,859 | 2/1987 | Walters | 285/317 |
| 5,046,761 | 9/1991 | Cordes | 285/7 |
| 5,305,984 | 4/1994 | Chen | 285/316 |
| 5,332,266 | 7/1994 | Canale | 285/7 |
| 5,692,782 | 12/1997 | Fischer | 285/7 |
| 5,836,620 | 11/1998 | Wang et al. | 285/7 |

FOREIGN PATENT DOCUMENTS 39 16 531 5/1990 Germany .

*Primary Examiner*—Eric K. Nicholson
*Attorney, Agent, or Firm*—Herbert Dubno

[57] ABSTRACT

A telescoping vacuum-cleaner pipe assembly has a guide sleeve on an outer pipe which cooperates with an actuating sleeve displaceable against the force of a ring spring on the guide sleeve to lock and unlock a detent engageable in recesses on an inner pipe. The ring spring is held between the actuating sleeve and an annular cap locking into the actuating sleeve.

10 Claims, 10 Drawing Sheets

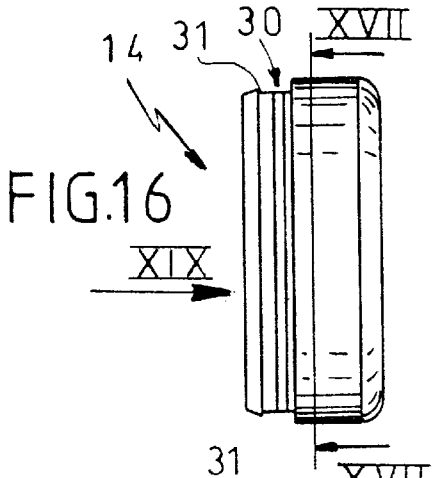
FIG.16
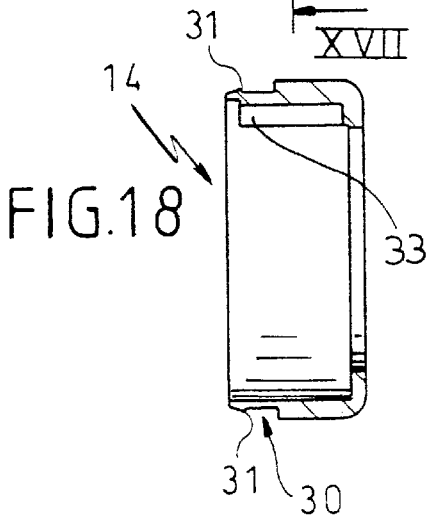
FIG.18
FIG. 19
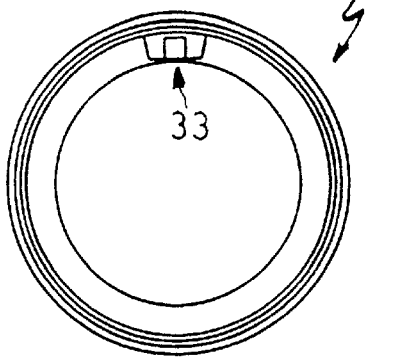
FIG.17
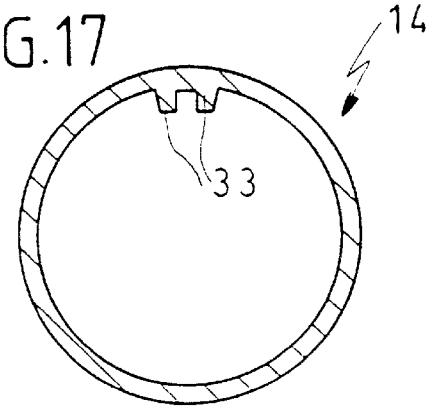
FIG. 20
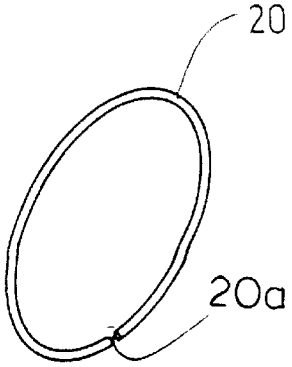

TELESCOPING VACUUM-CLEANER SUCTION PIPE ASSEMBLY

FIELD OF THE INVENTION

My present invention relates to a telescoping vacuum-cleaner suction pipe in which, between an outer pipe and an inner pipe, an actuating system is provided to enable relative axial adjustment of the inner pipe and the outer pipe.

BACKGROUND OF THE INVENTION

From U.S. Pat. No. 3,351,363, a telescoping assembly is provided between an outer pipe and an inner pipe of the suction conduit for a telescoping vacuum-cleaner conduit system in which the inner pipe is provided with a row or strip of indexing recesses with which a detent body or locking member on the outer pipe cooperates. In this system, a guide sleeve is provided on the outer pipe and carries the detent member while an actuating sleeve is usually displaceable on the guide sleeve and defines a space into which the detent member can move so that in one position of the actuating sleeve on the guide sleeve, the detent member is locked in one of the recesses while in another position of the actuating sleeve, the detent member can pass out of a recess of the inner pipe and allow relative axial movement of the two pipes.

The patent provides inner and outer annular plastic bodies which cooperate during the actuation and between which compression and springs are provided. The principal drawback of this arrangement is that the mounting of the assembly is problematical.

OBJECTS OF THE INVENTION

It is, therefore, the principal object of the present invention to provide a telescopingly adjustable assembly for a vacuum-cleaner suction pipe or conduit which can facilitate assembly of the adjustment mechanism and its attachment to inner and outer telescoping pipes of the suction conduit.

It is also an object of the invention to provide an assembly which reduces the mounting effort and hence the labor cost of assembling the adjusting mechanism.

Still another object of the invention is to provide an assembly which reduces the mounting effort and hence the labor cost of assembling the adjusting mechanism.

Still another object of the invention is to simplify the adjustable assembly between telescopingly interconnected inner and outer pipes of a vacuum-cleaner suction conduit.

Yet a further object of the invention is to eliminate drawbacks of earlier adjustment mechanisms for vacuum cleaner conduits.

SUMMARY OF THE INVENTION

These objects and others which will become apparent hereinafter are attained, in accordance with the invention in a telescoping vacuum-cleaner pipe assembly which comprises:

an outer pipe;

an inner pipe formed with an axially extending strip of detent recesses;

a detent selectively engageable in one of the recesses;

a guide sleeve on the outer pipe and telescopingly receiving the inner pipe, the guide sleeve retaining the detent;

an actuating sleeve surrounding the guide sleeve and defining a yielding space for the detent outwardly of the inner pipe;

an annular cap secured on an end of the actuating sleeve turned axially away from the outer pipe and movable with the actuating sleeve relative to the guide sleeve, the annular cap defining with the actuating sleeve an annular groove; and a spring element on an outer surface of the guide sleeve braced against the guide sleeve and received in the groove generating an axial restoring force between the guide sleeve and the actuating sleeve for retaining the detent in the one of the recesses.

According to this invention, therefore, the end of the actuating sleeve which is remote from the connection of the guide sleeve to the outer pipe is provided with the annular cap or ring cap so that the cap is movable jointly with the actuating sleeve relative to the guide sleeve and so that between the actuating sleeve and the cap a groove is provided to accommodate a spring element, preferably in the form of a circular ring bent from a rod and which is fitted in a groove on the exterior surface of the guide sleeve, the spring generating an axial restoring force for the actuating sleeve relative to the guide sleeve.

The device of the invention has the important advantage that it can be assembled or mounted in an especially simple manner. Essentially the device has only three main parts, namely, the guide sleeve, the actuating sleeve and the annular cap, all of which can be mounted on the telescoping tubes or pipes in a very simple manner.

For example, the guide sleeve can be affixed to the outer pipe and after the detent has been dropped into place in the guide sleeve, the actuating sleeve can be slid over the guide sleeve. After positioning of the spring element, the latter can be trapped between the actuating sleeve and the cap by simply snapping the cap into place into the actuating sleeve.

The outer surface of the actuating sleeve can be provided with gripping formations ergonomically suited to the hand of the user and facilitating manipulation of the actuating sleeve. In German Patent 39 16 531, the insertion of a ring or rod spring has been described in conjunction with a telescoping vacuum-cleaner pipe assembly, although a configuration similar to that which constitutes the present invention has not been described or shown.

In one embodiment of the invention, the split ring can be placed in a groove formed on the periphery of the guide sleeve in axial ribs which are formed on the guide sleeve.

The actuating sleeve and the cap can be locked together by a detent means in which an annular tooth of one of the members, i.e. the actuating sleeve or the cap, can engage an annular sawtooth formation of the other of these members. In this case, the engagement of the flanks of the formations can be such that separation of the cap from the actuating member is prevented without destruction.

Conversely, the locking arrangement between the cap and the actuating sleeve can permit release of the cap from the actuating sleeve. Here the locking formations can form a bayonet connection.

In another embodiment of the invention, the recess in the guide sleeve receiving the detent can be provided with means preventing the detent or locking member from falling through, thereby facilitating mounting and assembly. In this case, the detent can have stubs at its ends which are engageable in guide pockets at the ends of the recess, the pockets enabling the detent to move inwardly and outwardly while preventing the detent from fall through.

BRIEF DESCRIPTION OF THE DRAWING

The above and other objects, features, and advantages will become more readily apparent from the following description, reference being made to the accompanying drawing in which:

FIG. 16 is a side elevational view of the annular cap of the assembly;

FIG. 17 is a cross sectional view taken along the line XVII—XVII of FIG. 16;

FIG. 18 is an axial section through the annular cap;

FIG. 19 is an end view in the direction of arrow XVIV of FIG. 16;

FIG. 20 is a perspective view of the annular spring;

SPECIFIC DESCRIPTION

Figure 1:
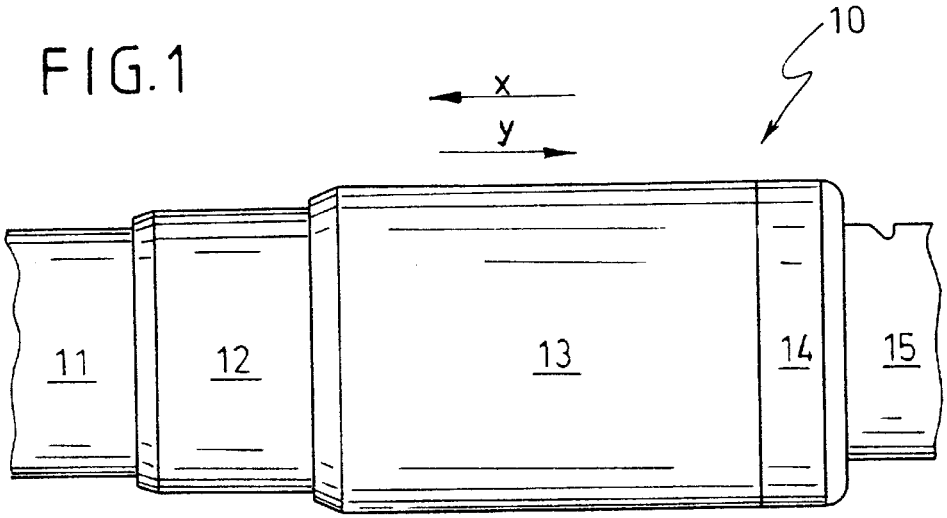
FIG. 1 is a side elevational view of an adjustable suction pipe assembly for a vacuum-cleaner pipe according to the invention.

FIGS. 1–22 are directed to a telescoping adjustable assembly for vacuum-cleaner piping, the assembly as a whole being designated at 10.

This assembly comprises an outer pipe 11, a guide sleeve 12 fixed on the outer pipe 11, an actuating sleeve 13 engaged over the guide sleeve 12 and shiftable in the longitudinal or axial direction, and a cap 14 coupled to the actuating sleeve 13 for joint movement axially therewith, an inner pipe 15 being received in the assembly and extending into the outer pipe 11.

Figure 2:
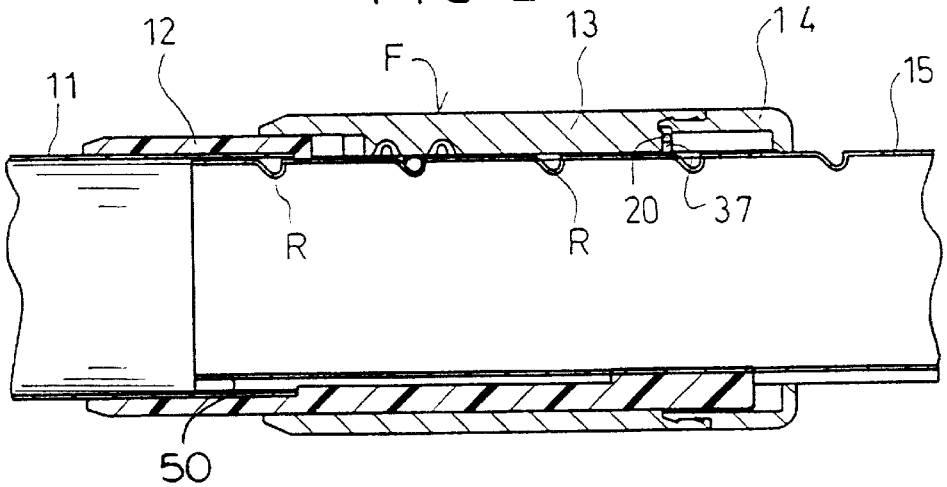
FIG. 2 is a longitudinal section of the adjustable telescoping assembly of FIG. 1.
Figure 3:
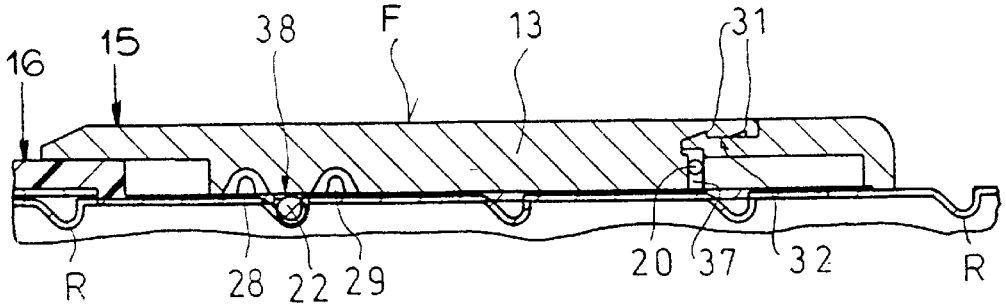
FIG. 3 is a detail of a portion of the assembly of FIG. 2, also in section.
Figure 4:
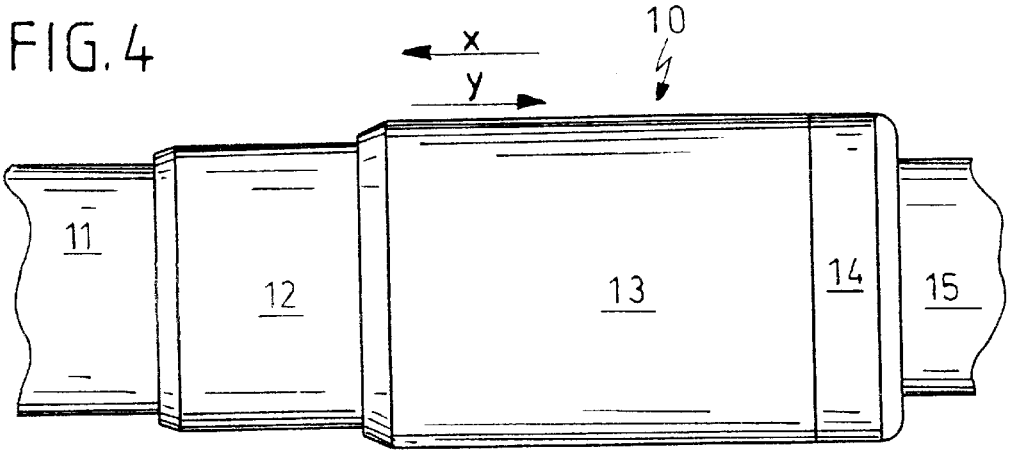
FIG. 4 is a view similar to FIG. 1 of the assembly in the unlocked position.
Figure 5:
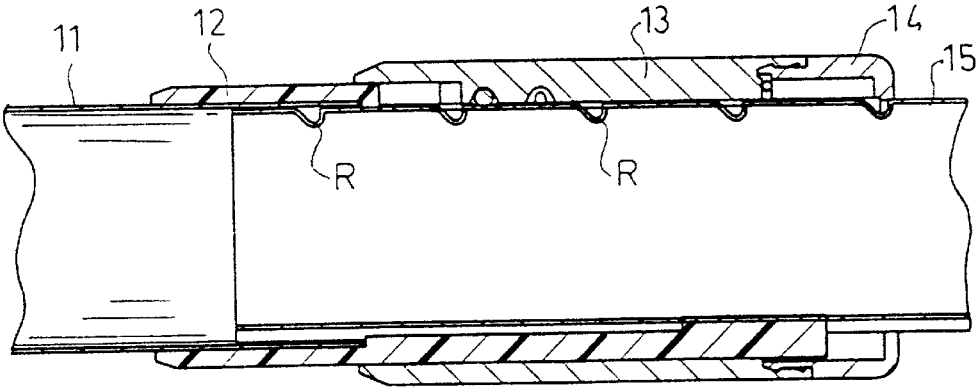
FIG. 5 is an axial section through the assembly in this unlocked position.
Figure 6:
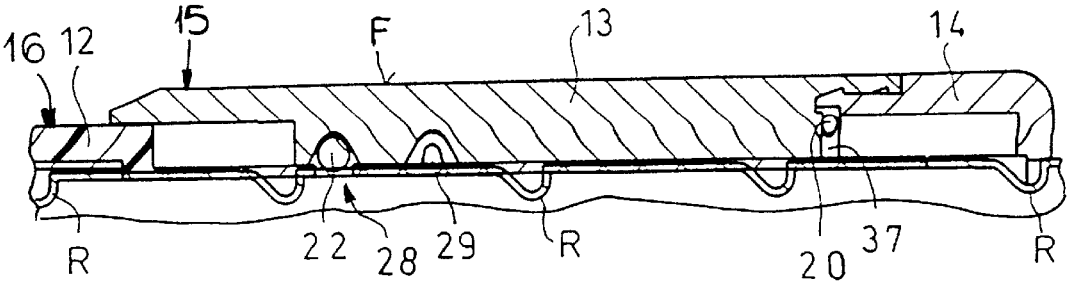
FIG. 6 is a detail view similar to FIG. 3 but showing this unlocked position.
Figure 7:
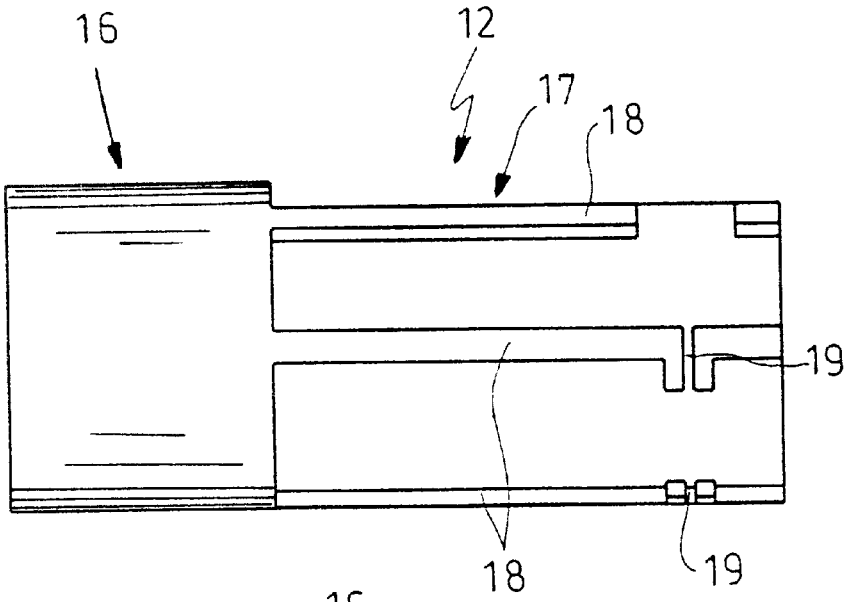
FIG. 7 is a side elevational view of the guide bushing of the assembly.

FIGS. 1–3 show the assembly in the locked state while FIGS. 4–6 depict the assembly in the unlocked state.

FIGS. 7–11 illustrate the guide sleeve 12 in greater detail. The guide sleeve 12 has, at one end a tubular region 16 which is affixed to the outer pipe 11 and region 7 which is substantially surrounded by the actuating sleeve 13. The region 17 of the guide sleeve 12 is provided with guide ribs 18 which, toward the end of the guide sleeve turned away from the outer pipe 11, defining an annular groove 19 in which the annular spring 20 (see FIG. 20) is received. In an upper region of the guide sleeve 12 the annular groove 29 in the region of ribs 18 is widened at A to provide play or mobility for the annular spring 20.

Figure 8:
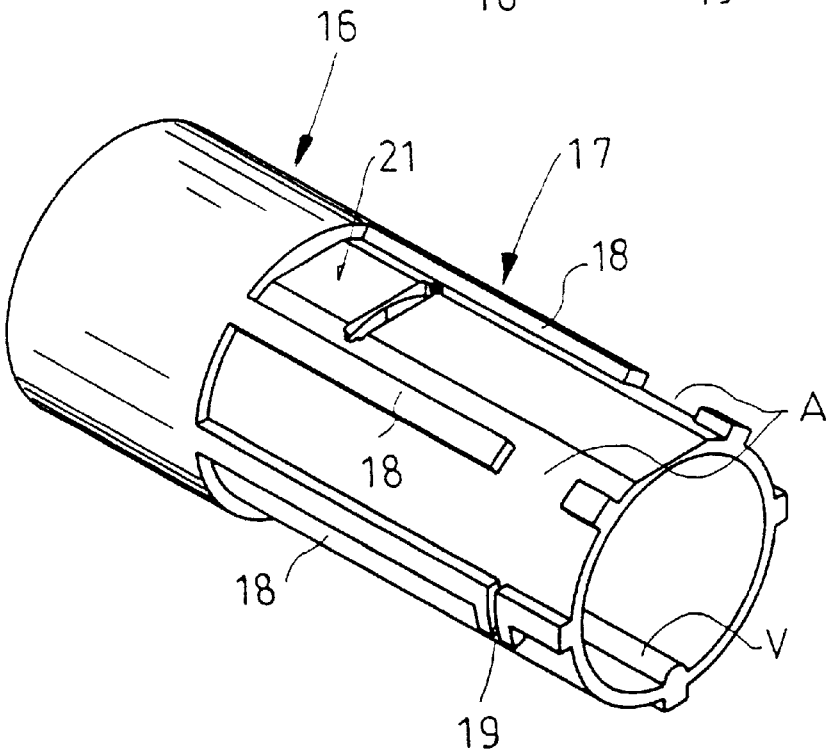
FIG. 8 is a perspective view of the guide bushing of FIG. 7.
Figure 9:
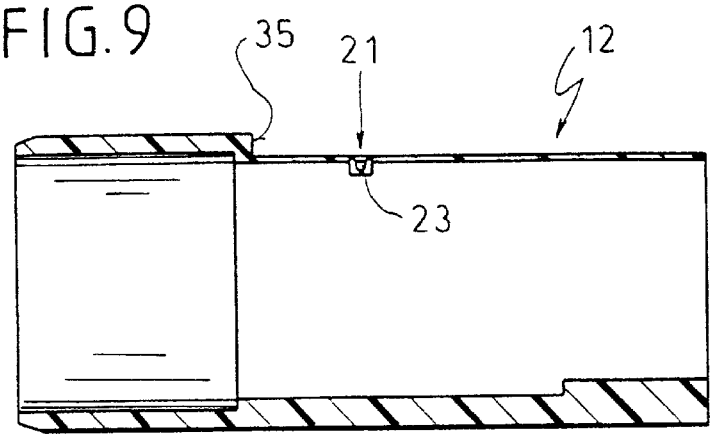
FIG. 9 is a longitudinal section through the guide bushing of FIG. 7.
Figure 10:
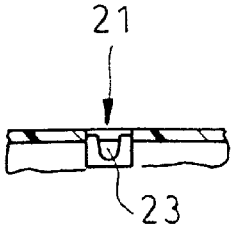
FIG. 10 is a detail view of a portion of this guide bushing.
Figure 11:
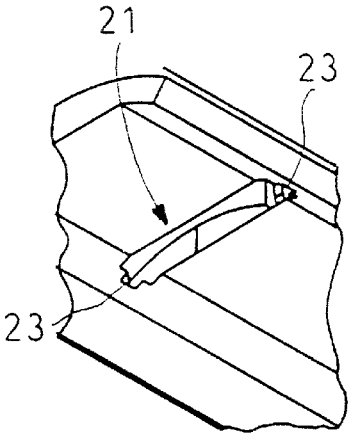
FIG. 11 is a perspective detail of a portion of FIG. 8.
Figure 12:
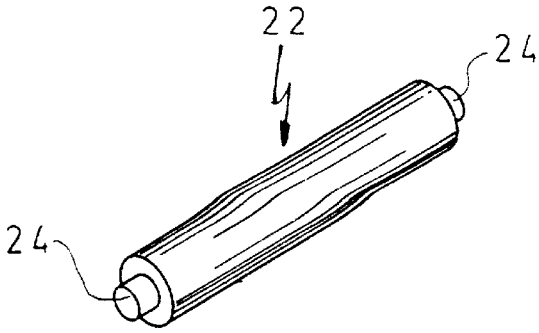
FIG. 12 is a perspective view of the detent or locking element of the assembly.

From the perspective view of FIG. 8 it will be apparent that at one of the ribs 18*a* longitudinal rib V is provided which can engage like a key in a longitudinal groove or keyway 50 of the inner pipe 15. The latter has a row or strip of outwardly open recesses, preferably diametrically opposite the keyway 50.

Figure 22:
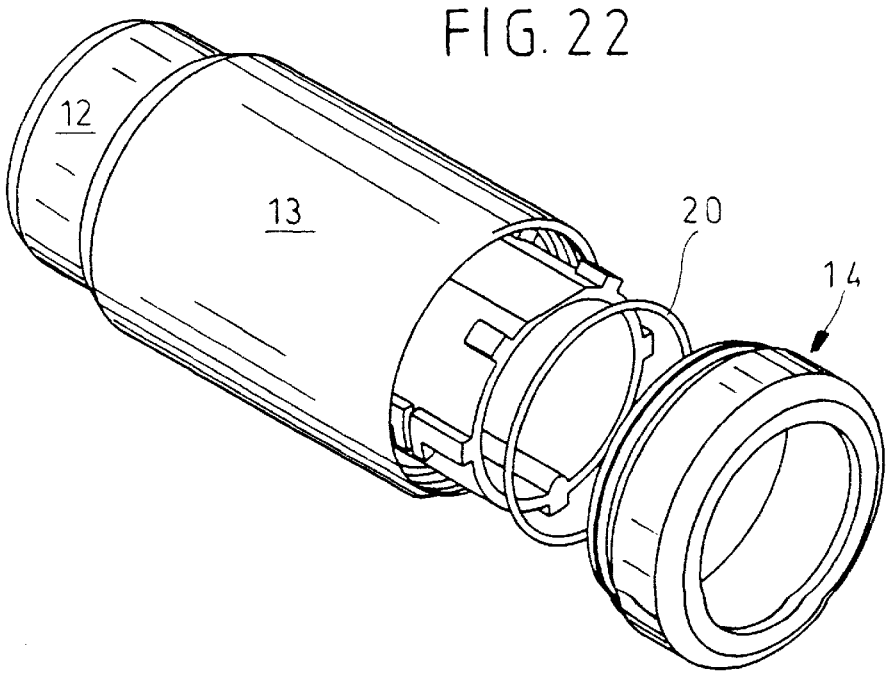
FIG. 22 is a perspective exploded view of the latter assembly.

In addition, the guide sleeve 12 has a recess 21 transverse to its axial or longitudinal direction to accommodate a detent or locking element (FIG. 22). As has been especially shown in FIGS. 9–11, the recess 21 has at both of its ends, pocket-like guides 23 into which the detent 22 with its stubs 24 at its ends can be dropped from above so that this detent does not fall through the recess 21.

Figure 13:
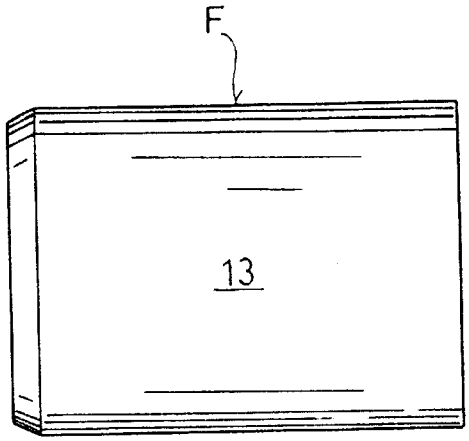
FIG. 13 is a side elevational view of the actuating sleeve of the assembly.
Figure 14:
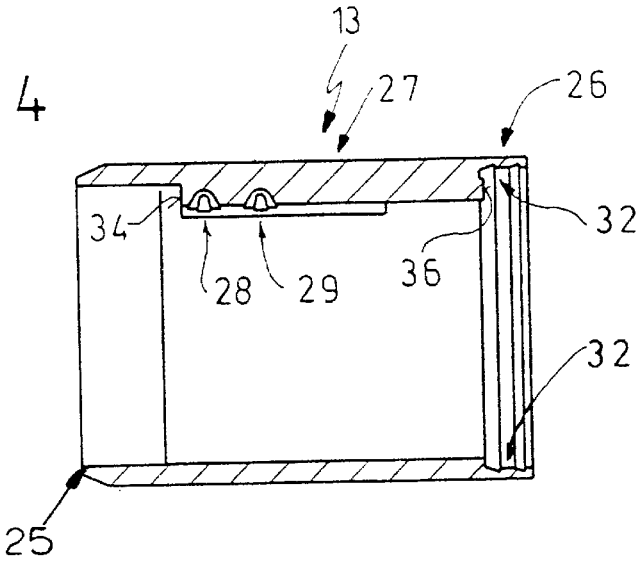
FIG. 14 is a longitudinal (axial) section through this sleeve.
Figure 15:
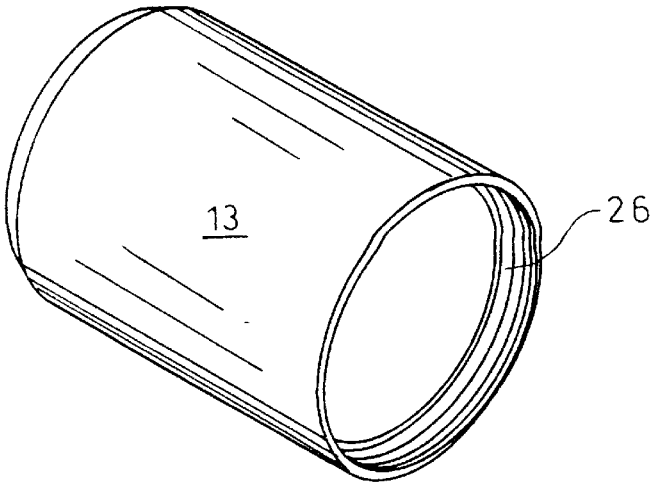
FIG. 15 is a perspective view of the actuating sleeve of FIG. 13.
Figure 21:
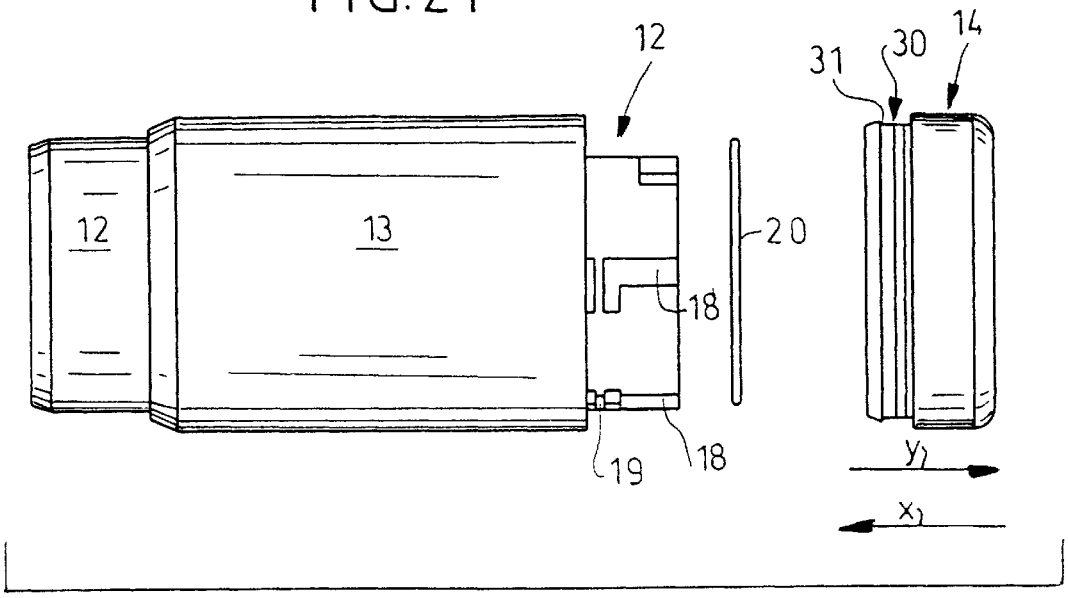
FIG. 21 is an exploded view of the assembly of the guide sleeve, the actuating sleeve, the annular spring and the annular cap.

As can be seen from FIGS. 13–15, the actuating sleeve 13 has an overlapping region 25 which, in the mounted state, more or less accommodates or surrounds the region 16 previously described of the guide sleeve 12. At the opposite end of the actuating sleeve 13, the latter is formed with a region 26 to which the annular cap 14 is fixed. The intermediate region 27 is formed internally with two recesses 28 and 29 which can accommodate the detent 22 on external peripheral surface F of the actuating sleeve can be gripped by the hand of the user and, although not illustrated can be illustrated for such arrangement by the hand in the ergonomic manner. Finger recesses or notches can, for example, be provided on the periphery of the actuating sleeve.

FIGS. 16–19 show the annular cap 14 in greater detail. This annular cap 14 has a fastening region 30 which is provided with an annular barb or projection 31 which can engage in a sawtooth formation 32 on the interior of the region 26 of the actuating sleeve 13. In addition (see FIGS. 17 and 18), within the annular cap 14, two ribs 33 can be provided which function as will be described in greater detail below.

FIG. 20 shows the annular spring 20 which may be formed with a split 20*a* and which can be fitted in the annular groove 19 to provide the axial bias which is desirable in the assembly.

The assembly can be fabricated independently from the outer pip 11 and the inner pipe 15, can be premounted on the outer pipe 11, or can be partly premounted and partly assembled after, say, the guide sleeve has been applied to the outer pipe. The inner and outer pipes and the assembly can be permanently fitted together with only adjustability of the pipes permitted by the assembly or can allow complete separation of the inner pipe 15 from the balance of the assembly.

Basically, the detent or locking element 22 is initially fitted into the recess 21 in the guide sleeve 12, the detent being held in place by the pocket-like guides 23 then the actuating sleeve 13 can be fitted in the direction of the arrow (FIGS. 1 and 4) on the guide sleeve and displaced thereon until a shoulder 34 of the actuating sleeve 13 abuts a shoulder 35 of the guide sleeve 12. In this position (see FIG. 21) the annular groove 19 is exposed to enable fitting of the annular spring 20 therein. Hence the annular spring 20 can then be fitted over the guide sleeve 12 in the groove 19.

Figure 29:
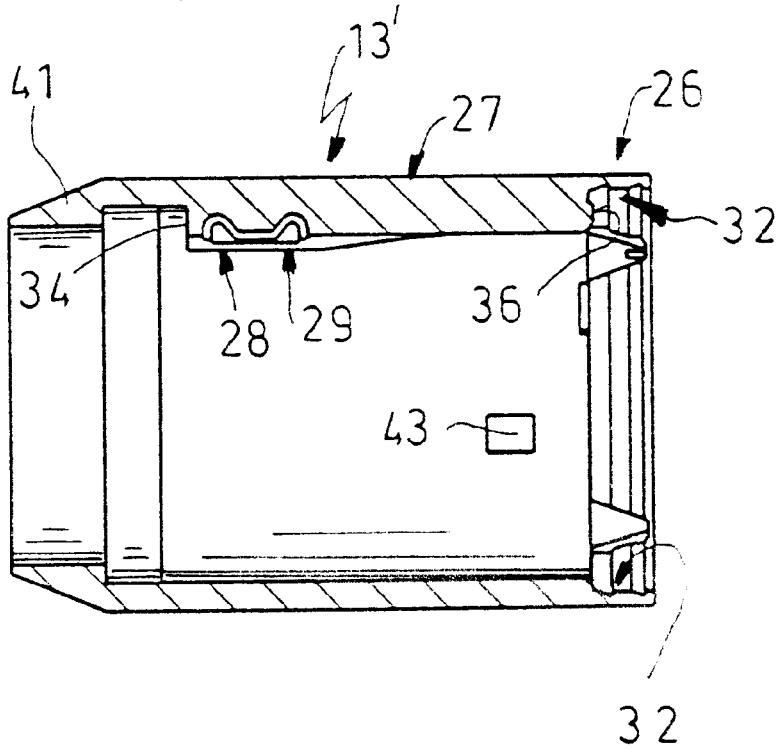
FIG. 29 is an axial section through this actuating sleeve.

After fitting of the annular spring 20 on the guide sleeve 12 and in the groove 19, as is permitted by the split in the ring, the actuating sleeve 13 is shifted in the y direction (FIGS. 1 and 4) until the shoulder surface 36 (FIG. 29) abuts the annular spring 20. The ring cap 14 is then applied in the x direction and forced into the actuating sleeve 13 until the tooth formations 31 and 32 interengage. This causes an interconnection of the fastening regions 26 and 30.

With this assembly technique, the annular spring 20 is trapped between the actuating sleeve 13 and the end cap 14 and, in particular, between the shoulder 36 of the actuating sleeve 13 and the seat 33 of the cap 14 in an annular groove represented at 37 in FIGS. 2, 3 and 6.

Because the annular spring 20 is trapped in the annular groove 37 between the actuating sleeve 13 and the cap 14, the spring can axially bias the actuating sleeve 13 relative to the guide sleeve 12 into its original position when released by the hand of the user. This position corresponds to the relieved condition of the spring and corresponds to the lock position shown in FIGS. 1–3, wherein a portion 38 of the actuating sleeve 13 cams the detent 22 into one of the indexing grooves or recesses R of the inner tube 15 and holds the detent in place. The recess 21 of the guide sleeve 12 is covered by the surface 38 in this position.

If, then, the actuating sleeve 13 together with the annular cap 14 is displaced in the y direction against the force of the spring 20, the position shown in FIGS. 4–6 is reached and unlocking of the assembly 10 is permitted. In this position, the recess 21 is radially aligned with a recess in the actuating sleeve 13 shown at 28, thereby enabling the detent 22 to move upwardly out of the recess R of the inner pipe 15. The inner and outer pipes can then be slid axially to one another until the detent 22 is seated in another of the recesses R.

Figure 23:
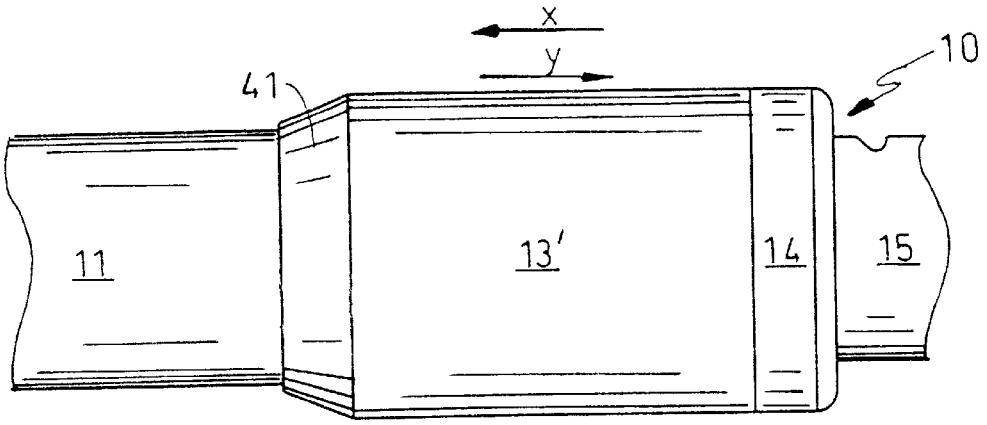
FIG. 23 is a side elevational view of another embodiment of the adjustable assembly according to the invention in the locked position.
Figure 24:
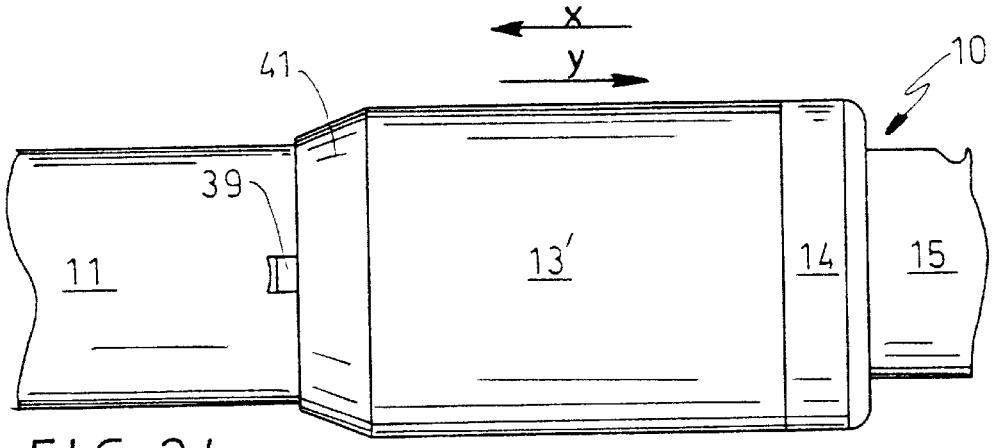
FIG. 24 is a side elevational vie of the assembly of FIG. 23 in the unlocked position.
Figure 25:
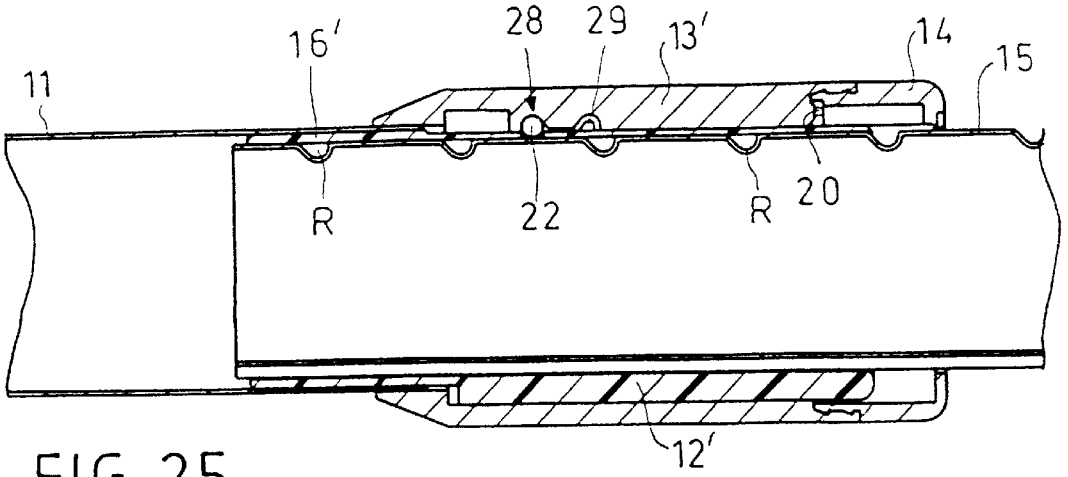
FIG. 25 is a longitudinal section through the assembly in the position shown in FIG. 24.
Figure 26:
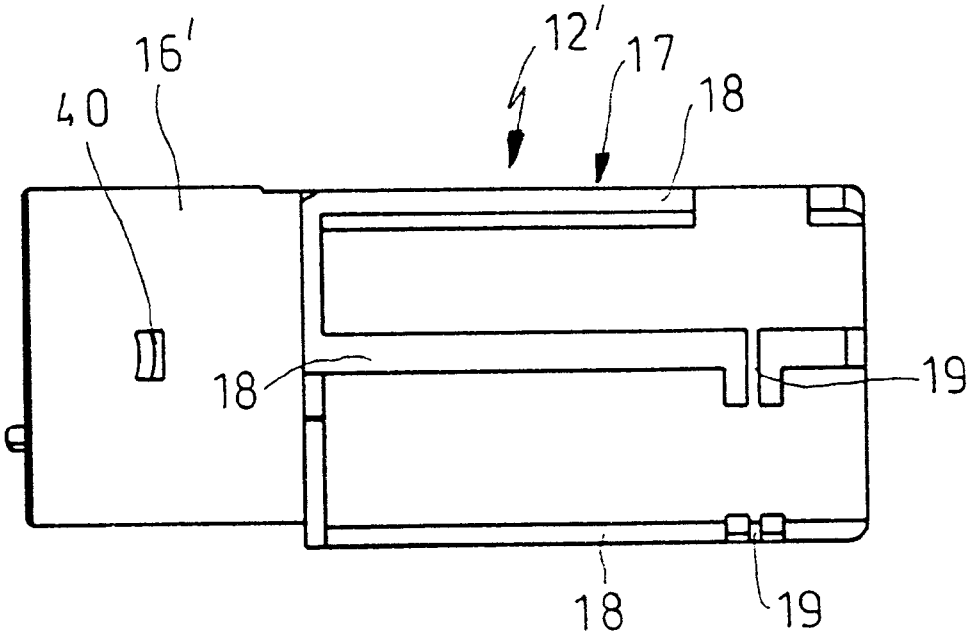
FIG. 26 is a side elevational view of a guide sleeve for the embodiment of FIGS. 23–25.
Figure 27:
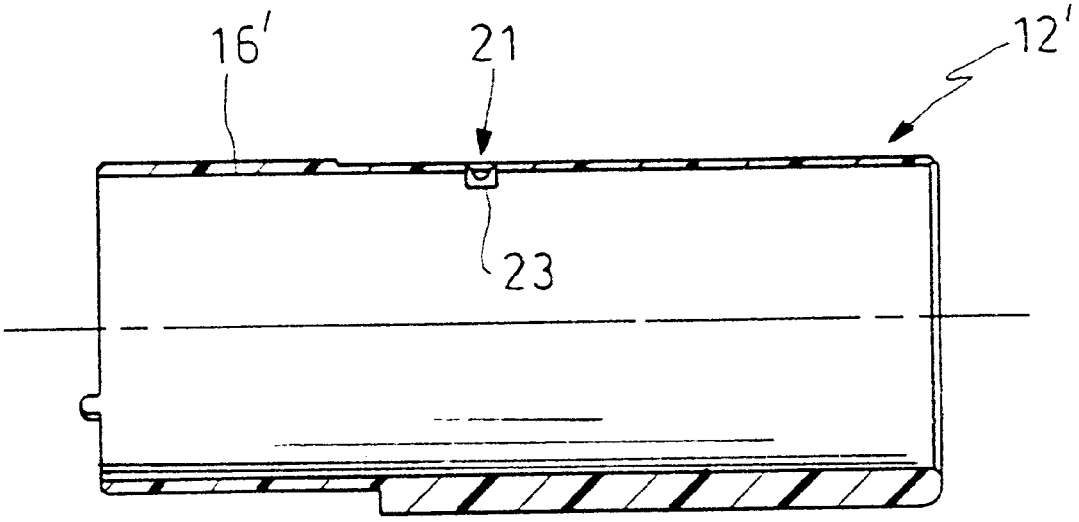
FIG. 27 is a longitudinal section through the guide sleeve of FIG. 26.
Figure 28:
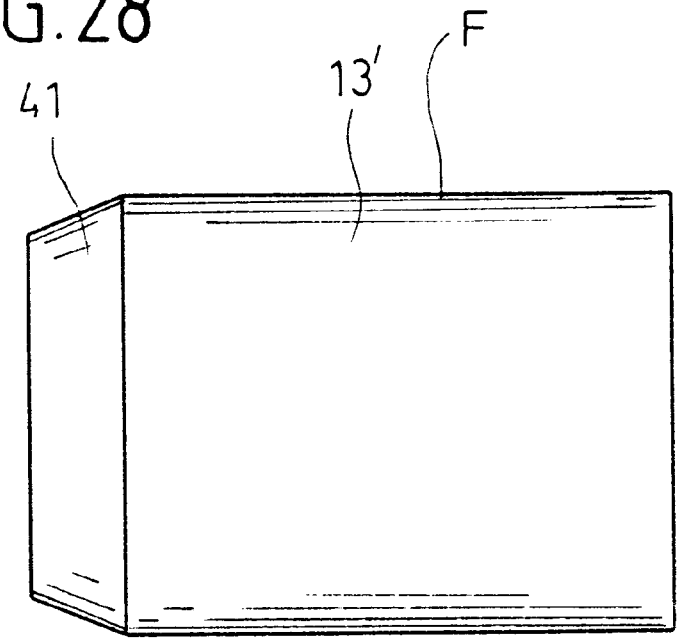
FIG. 28 is a side elevational view of an actuating sleeve for the embodiment of FIGS. 23–27.

FIGS. 23–29 show another embodiment of the assembly 10 with FIGS. 23, 24 and 25 corresponding especially to FIGS. 1, 4 and 5 previously described. The difference between the two embodiments is that the embodiment of FIGS. 23–29 has a guide sleeve 12' which has a reduced diameter portion 16' over which the outer pipe 11 can be forced and which locks into the outer pipe 11 by a tongue 40 engageable in a recess 39 in the outer pipe.

The actuating sleeve 13' has, toward its end turned toward the outer pipe 11, an end region which is frustoconical and has been represented at 41 and which in the unlocked state engages over an end region 42 of the outer pipe.

Finally, the actuating sleeve 13' on its inner periphery a projection 43 (FIG. 29) which acts as an abutment and serves to prevent excessive displacement of the actuating sleeve 13' in the y direction (FIGS. 23 and 24).

This embodiment allows a further simplification in mounting, because of the different construction of the guide sleeve 12' and the actuating sleeve 13', not only can the detent 22 be positioned prior to mounting of the assembly 10 on the pipes, but the annular spring 20 can also be previously mounted on the guide sleeve 12'. The actuating sleeve 13' can then be shifted over the smaller diameter region 16' of the guide sleeve 12' until the shoulder 36 engages the spring 20, whereupon the cap 14 can be applied. That assembly can then be pressed into the outer pipe 11 until the tongue 40 of the guide sleeve 12' on the thinner and more yieldable cylindrical portion 16' engages in the recess 39 of the outer pipe 11.

I claim:

1. A telescoping vacuum-cleaner pipe assembly comprising:

an outer pipe;

an inner pipe formed with an axially extending strip of detent recesses;

a detent selectively engageable in one of said recesses;

a guide sleeve on said outer pipe and telescopingly receiving said inner pipe, said guide sleeve retaining said detent;

an actuating sleeve surrounding said guide sleeve and defining a yielding space for said detent outwardly of said inner pipe;

an annular cap secured on an end of said actuating sleeve turned axially away from said outer pipe and movable with said actuating sleeve relative to said guide sleeve, said annular cap defining with said actuating sleeve an annular groove; and a spring element on an outer surface of said guide sleeve braced against said guide sleeve and received in said groove generating an axial restoring force between said guide sleeve and said actuating sleeve for retaining said detent in said one of said recesses.

2. The telescoping vacuum-cleaner pipe assembly according to claim 1 wherein said spring element is a rod-type spring bent into a circular form.

3. The telescoping vacuum-cleaner pipe assembly according to claim 1 further comprising means for coupling said actuating sleeve and said annular cap nondetachably to one another.

4. The telescoping vacuum-cleaner pipe assembly as defined in claim 3 wherein said means for coupling includes a tooth formation on one of said actuating sleeve and said annular cap and a sawtooth formation engageable therewith on the other of said actuating sleeve and annular cap.

5. The telescoping vacuum-cleaner pipe assembly as defined in claim 1 further comprising means for releasably connecting said annular cap to said actuating sleeve.

6. The telescoping vacuum-cleaner pipe assembly as defined in claim 1 wherein said guide sleeve is provided with a recess for receiving said detent and with means for limiting inward movement of said detent in said recess in said guide sleeve.

7. The telescoping vacuum-cleaner pipe assembly as defined in claim 6 wherein said means for limiting includes stubs on opposite ends of said detent and pocket guides formed at opposite ends of said recess of said guide sleeve for receiving said stubs.

8. The telescoping vacuum-cleaner pipe assembly as defined in claim 1 wherein said actuating sleeve is provided with abutment means for limiting displacement of said actuating sleeve away from said upper pipe.

9. The telescoping vacuum-cleaner pipe assembly as defined in claim 1 wherein said guide sleeve has a region engageable over said outer pipe for securing said guide sleeve to said outer pipe.

10. The telescoping vacuum-cleaner pipe assembly as defined in claim 1 wherein said guide sleeve has a region received in said outer pipe and securing said guide sleeve to said outer pipe.

* * * * *